US006096489A

United States Patent [19]

McGuckin et al.

[11] Patent Number: 6,096,489

[45] Date of Patent: *Aug. 1, 2000

[54] COLOR DEVELOPING COMPOSITION AND METHOD OF USE IN PHOTOPROCESSING

[75] Inventors: Hugh G. McGuckin, Rochester; John S. Badger, Webster; Frank A. Pettrone, Rochester, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/223,861

[22] Filed: Dec. 31, 1998

[51] Int. Cl.[7] ..... G03C 7/413

[52] U.S. Cl. ..... 430/486; 430/488; 430/493

[58] Field of Search ..... 430/486, 488, 430/490, 491, 493

[56] References Cited

U.S. PATENT DOCUMENTS

| | | | |
|---|---|---|---|
| 4,252,892 | 2/1981 | Case | 430/357 |
| 4,414,307 | 11/1983 | Kapecki et al. | 430/465 |
| 4,882,264 | 11/1989 | Kim et al. | 430/467 |
| 5,279,930 | 1/1994 | Green et al. | 430/498 |
| 5,578,430 | 11/1996 | Fyson | 430/401 |
| 5,595,860 | 1/1997 | Ishikawa et al. | 430/372 |
| 5,686,229 | 11/1997 | Twist | 430/373 |
| 5,786,134 | 7/1998 | Nair et al. | 430/517 |
| 5,814,437 | 9/1998 | Nakahanada et al. | 430/393 |
| 5,965,334 | 10/1999 | Fyson et al. | 430/373 |

FOREIGN PATENT DOCUMENTS

| | | | |
|---|---|---|---|
| 404011254 | 1/1992 | Japan | 430/493 |

*Primary Examiner*—Hoa Van Le
*Attorney, Agent, or Firm*—J. Lanny Tucker

[57] ABSTRACT

A photographic color developing composition includes a color developing agent and at least 0.005 g/l of an anti-tar agent. Such anti-tar agents include a fluoroalkylpolyethyleneoxy alcohol, polyvinyl alcohol, a polyethylene glycol, a free acid of an organic phosphate ester or a salt thereof, or a polyethyleneoxide(20) sorbitan monooleate Inclusion of these agents has been found to significant reduce or elimination tar formation during the processing of color photographic materials, especially color motion picture films.

11 Claims, No Drawings

COLOR DEVELOPING COMPOSITION AND METHOD OF USE IN PHOTOPROCESSING

FIELD OF THE INVENTION

The present invention relates to photographic color developing compositions and to their use in the processing of color photographic silver halide materials especially color motion picture films. More specifically, it relates to photographic color developing compositions containing certain additives that reduce tar formation during use in photoprocessing. These compositions and methods arc useful in the field of photography.

BACKGROUND OF THE INVENTION

The fundamental steps in photographic processing include a color developing step and a silver removal step. In the color developing step, photographic color developing compositions are used to process color photographic materials such as color photographic films (including motion picture films) and papers to provide the desired color images. Such compositions generally contain color developing agents [for example 4-amino-3-methyl-N-(β-methane sulfonamidoethyl)aniline and other p-phenylenediamines] as reducing agents to react with suitable color forming couplers in the color photographic materials to form the desired dyes. However, such color developing agents are susceptible to oxidation by dissolved oxygen. Therefore, an antioxidant is conventionally included in the color developer compositions to preserve the oxidation state of the color developing agent and thereby maintain useful color developer activity.

Color developing compositions are carefully formulated with various additives to overcome various problems besides the problems arising with color developing agent oxidation. Thus, metal ions, various sequestering agents, surfactants and other components have been added over the years to provide the stability and photographic activity that is critical to the industry.

One problem that is a concern in the industry is the formation of "tar" in and from the color developing composition. Tar has been variously defined as deposits of "polymeric oxidized developer" (see U.S. Pat. No. 5,786,134 of Nair et al) as relating to motion picture print films, and as the results of inadequate dissolution or mixing of benzyl alcohol as described in U.S. Pat. No. 4,414,307 (Kapecki et al). Basically, this undesirable substance appears to be products of the degradation of the color developing agents. The effect of tar on the processed photographic materials is a loss of image detail during viewing. This is especially noticeable when motion picture films are projected onto wide screens. In addition, the effects of tar buildup in the photographic processing lab include clogged filters and plumbing, and dirtier processing tanks, resulting in frequent downtime for cleaning. Thus, tar reduction is a continuing goal of the photographic industry in an effort to improve image quality of color images of all types and sizes.

The industry has addressed this problem of tar formation in various ways. A solution to the problem is merely to replace the processing solutions frequently. Thus, the photographic processing operators would discard color developing solutions frequently to remove the unwanted by-products that result in tar and thereby avoid more tedious cleaning routines. This can be quite expensive in time and labor, downtime, and in the cost of processing solutions.

Photographic processing innovators in the industry have attempted to save their customers from having to do this by adjusting the color developing compositions. For example, U.S. Pat. No. 4,882,264 (Kim et al) describes the use of two or more color developing agents in combination in the color developing compositions. U.S. Pat. No. 5,786,134 (noted above) addresses changes in protective overcoats in motion picture films. Additives to the color developing compositions that are considered to reduce tar formation include poly(alkyleneimines) as described in U.S. Pat. No. 4,252,892 (Case) and solubilizing compounds for benzyl alcohol as described in U.S. Pat. No. 4,414,307 (noted above). In addition, it has been know for many years that the presence of sulfonated polystyrenes (commercially available as VERSA TL71 or TL73) in color paper developing compositions reduces tar formation as described for example in U.S. Pat. No. 5,279,930 (Green et al) and U.S. Pat. No. 5,578,430 (Fyson).

While the industry has provided some solutions to the problem of tar formation, there is continuing need to find an inexpensive means for solving the problem without the need for the customer experience expensive downtime or cleaning routines, especially during processing of motion picture films.

SUMMARY OF THE INVENTION

The problems noted above are overcome with a photographic color developing composition comprising:

a) at least 0.005 mol/l of a color developing agent, and b) at least 0.005 g/l of an anti-tar agent that is selected from the group consisting of a fluoroalkylpolyethyleneoxy alcohol, polyvinyl alcohol, a polyethylene glycol, a free acid of an organic phosphate ester or salt thereof, and a polyethyleneoxide(20) sorbitan monooleate.

Further, the present invention provides a method of providing a color photographic image comprising:

A) color developing an imagewise exposed color photographic silver halide element, with the color developing composition described above, and B) desilvering the color developed color photographic silver halide element.

The color developing composition of this invention can be provided as part of a kit that includes one or more other photoprocessing compositions, such as a bleach-fixing composition, a bleaching composition, a fixing composition, or a final rinse or a stabilizing composition, or other compositions necessary for color development (that is, additional color developing "parts").

The color developing compositions of this invention are less likely to have tar formed after extended use, especially during the processing of color motion picture films. The benefits of less tar formation are quite obvious from the previous discussion, that is less downtime for cleaning processing tanks and plumbing, less wasted processing compositions and high quality color images.

These advantages are achieved by the inclusion of certain anti-tar agents into the color developing composition or into a "part" that will be used to make up a color developer solution. These anti-tar agents fall into several classes of materials, namely the specific types of compounds noted above. The classes of materials include polyvinyl alcohol, polyethylene glycols, certain nonionic fluorosurfactants, a free acid or salt of organic phosphate esters and polyethyleneoxide sorbitan derivatives. Further details of these materials are provided below.

DETAILED DESCRIPTION OF THE INVENTION

The color developing compositions of this invention include one more anti-tar agents are defined herein. This color developing composition can also include one or more color developing agents that are also defined below. The composition can encompass all components necessary for color development, or it can be one "part" of multiple "parts" that are eventually mixed together to form the color developing solution. Thus, the anti-tar agent can be included in the color developing solution used in processing in a number of ways. It can be added in one ol the "parts" used to formulate the solution, or it can be added directly to the color developing solution before or during photoprocessing.

The anti-tar agents useful in this invention are chosen from several classes of materials, namely polyvinyl alcohol, certain nonionic fluorosurfactants, a free acid or sodium salt of complex organic phosphate esters and polyethyleneoxide sorbitan derivatives.

The nonionic fluorosurfactants can be purchased from a number of sources, for example as ZONYL FSO surfactant (DuPont). Other similar compounds would be readily apparent to a skilled worker in the art.

The free acid or sodium or other salts of organic phosphate esters are readily available as various commercial surfactants including KLEARFAC AA270 surfactant (BASF Corporation) and RHODAFAC LO-529 (Rhone-Poulenc). Other useful compounds of this type would be readily apparent to one skilled in the art.

The polyethyleneoxide sorbitan derivatives are also well known and can be obtained for example as TWEEN 80 surfactant (ICI Surfactants). Other similarly useful materials would be readily apparent to one skilled in the art.

Useful polyethylene glycols should have appropriate molecular weight to be soluble or dispersible in aqueous solutions (such as color developing solutions) and to act as dispersants in those environments. A useful polyethylene glycol is available as CARBOWAX 350 (Union Carbide), but others would be readily apparent to a skilled worker in the art.

The described anti-tar agents can be used singly or in admixture in the color developing composition. They are generally present in the composition in an amount of at least 0.005 g/l, and preferably at from about 0.01 to about 5 g/l. Optimum amounts of each particular anti-tar agent can be readily determined from routine experimentation by a skilled worker in the art, especially in view of the working examples provided below.

In order to protect the color developing agents from oxidation one or more antioxidants or preservatives are included in the color developing compositions. Besides the conventional sulfites used for this purpose, many classes of useful organic antioxidants are known, including but not limited to, hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123976 (filed Jul. 29, 1998 by Qiao and McGarry). Mixtures of compounds from the same or different classes of antioxidants can also be used if desired.

Some useful organic antioxidants are hydroxylamine derivatives as described for example, in U.S. Pat. No. 4,892,804, U.S. Pat. No. 4,876,174, U.S. Pat. No. 5,354,646, and U.S. Pat. No. 5,660,974, all noted above, and U.S. Pat. No. 5,646,327 (Burns et al), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, phosphono, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Manese et al), incorporated herein by reference, as having the structure I:

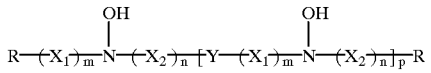

wherein R is hydrogen, a substituted or unsubstituted alkyl group of 1 to 10 carbon atoms (preferably 1 to 7 carbon atoms, branched or linear), a substituted or unsubstituted haloalkyl groups of 1 to 10 carbon atoms (preferably 1 to 3 carbon atoms, and 1 or 2 chloro atoms), a substituted or unsubstituted hydroxyalkyl group of 1 to 10 carbon atoms (preferably 1 to 3 carbon atoms), a substituted or unsubstituted cycloalkyl group of 5 to 10 carbon atoms (preferably cyclohexyl), or a substituted or unsubstituted aryl group having 6 to 10 carbon atoms in the aromatic nucleus (preferably phenyl).

$X_1$ is —$C(OH)R_2CHR_1$— and $X_2$ is —$CHR_1C(OH)R_2$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms in the chain, or Y is a substituted or unsubstituted divalent aliphatic group having an even total number of carbon and oxygen atoms in the chain, provided that the aliphatic group has a least 4 atoms in the chain.

The substituents on such radicals defining the organic antioxidant can be any group that does not interfere with the performance of the compound or the photochemical performance of the color developing composition.

Also in Structure I, m, n and p are independently 0 or 1. Preferably, each of m and n is 1, and p is 0.

Specific disubstituted hydroxylamine antioxidants include, but are not limited to: N,N-bis(2,3-dihydroxypropyl)hydroxylamine, N,N-bis(2-methyl-2,3-dihydroxypropyl)hydroxyl amine and N,N-bis(1-hydroxymethyl-2-hydroxy-3-phenylpropyl)hydroxylamine. The first compound is preferred.

Many of the noted organic antioxidants are either commercially available or prepared using starting materials and procedures described in the references noted above in describing hydroxylamines.

A sulfite or an organic antioxidant is generally included in the color developing composition of this invention in an amount of at least 0.005 mol/l, and preferably at least 0.02 mol/l. Generally, the composition has up to 2 mol/l, and preferably up to 1 mol/l.

When the color developing composition of this invention is in an aqueous form, its pH is generally from about 9 to about 13 (preferably from about 9 to about 12), as provided by the addition of one or more weak or strong bases (such as a hydroxide) or buffers in amounts readily known in the art. Particularly useful buffers include, but are not limited to, carbonates, borates, tetraborates, phosphates, glycine salts, leucine salts, valine salts, proline salts, alanine salts, aminobutyric acid salts, lysine salts, guanine salts and hydroxybenzoates.

The developing compositions of this invention include one or more color developing agents, of which there are hundreds of possibilities. Such materials include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure,* publication 38957, pages 592–639 (September 1996). *Research Disclosure* is a publication of Kenneth Mason Publications Ltd., Dudley House, 12 North Street. Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. The first color developing agent is most preferred in the practice of this invention.

The color developing agent is generally present in the developing composition generally in an amount of at least 0.005 mol/l, and preferably at least 0.01 mol/l. Generally, such compounds are present in an amount of up to 1 mol/l and preferably up to 0.5 mol/l.

The color developing compositions can be easily prepared by mixing a suitable color developing agent, organic antioxidant, an anti-tar agent and any other desired additives as described herein, in a suitable aqueous solution, or dry powder mixtures. Water can be added to resulting solutions to provide the desired concentrations of the components, and the pH can be adjusted as noted above.

The developing compositions can also include one or more of a variety of other addenda which are commonly used in such compositions, including alkali metal halides (such as potassium chloride, potassium bromide, sodium bromide and sodium iodide), buffers (as noted above), antifoggants, development accelerators, optical brightening agent (such as a triazinylstilbene), wetting agents, stain reducing agents, surfactants, defoaming agents, and water-soluble or water-dispersible color couplers, as would be readily understood by one skilled in the art [see for example, *Research Disclosure,* noted above, U.S. Pat. No. 5,738,979 (noted above) and U.S. Pat. No. 4,814,260 of Koboshi et al]. The amounts of such additives are well known in the art also. Preferred color developing compositions are described below in Examples 1–3.

The color developing compositions of this invention are preferably formulated and used as an aqueous solution, either as the working strength solution or as a replenishing solution, or in concentrated form. However, as is known in the art, photographic developing compositions can also be formulated and used as dry tablets, powders or granules. The technology for this embodiment is readily known in the art, such as U.S. Pat. No. 5,362,610 (Yoshimoto), U.S. Pat. No. 5,376,509 (Yoshimoto et al) and EP-A-0 611 986A1 (published Aug. 24, 1994).

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color films and papers, and color motion picture films) containing various types of emulsions can be processed using the present invention, the types of elements being well known in the art (see *Research Disclosure,* noted above). In particular, the invention can be used to process photographic color papers of all types of emulsions, including so-called "high chloride" and "low chloride" type emulsions, and so-called tabular grain emulsions as well. The color developing composition can also be used in color reversal processing of color reversal films and papers.

The present invention is particularly useful to process high chloride (greater than 70 mole % chloride and preferably greater than 90 mole % chloride, based on total silver) emulsions in photographic color papers. Such color papers can have any useful amount of silver coated in the one or more emulsions layers, and in some embodiments, low silver (that is, less than about 0.7 g silver/$m^2$) elements are processed with the present invention. The layers of the photographic elements can have any useful binder material or vehicle as it known in the art, including various gelatins and other colloidal materials.

The invention is particularly useful for processing color motion picture films (such as motion picture color negative, intermediate and print films), including but not limited to those described in U.S. Pat. No. 5,786,134 (noted above).

Color development of an imagewise exposed photographic silver halide element is carried out by contacting the element with the color developing composition of this invention under suitable time and temperature conditions, in suitable processing equipment, to produce the desired color and silver image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional KODAK Process C-41 processing of color negative films, conventional KODAK Process RA-4 for processing color papers, conventional KODAK Process E-6 for processing color reversal films (see for example, *Research Disclosure*), and conventional KODAK Process ECN-2 and ECP-2B for color motion picture films.

The photographic color elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure,* noted above. Included within such teachings in the art is the use of various classes of cyan, yellow and magenta dye forming color couplers that can be used with the present invention (including pyrazolone and pyrazolotriazole magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The elements are typically exposed to suitable radiation to form a latent image and then processed to form a visible dye and silver image. Processing then includes the step of color development in the presence of a color developing agent to reduce developable silver halide and to oxidize the color developing agent. Oxidized color developing agent in turn reacts with a color-forming coupler to yield a dye.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al) and publications noted therein.

Color development is generally followed by a bleaching and fixing steps or a bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure,* noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al). Conventional fixing agents, such as thiosulfate and thiocyanates, can be used for the steps including fixing.

The processing time and temperature used for each processing step of the present invention are generally those conventionally used in the art. For example, color development is generally carried out at a temperature of from about 20 to about 60° C. The overall color development time can be up to 10 minutes, and preferably less than 450 seconds. Overall development times of up to 50 seconds are generally used for processing photographic color papers, and preferably less than 35 seconds is used.

The color developing composition of this invention can be formulated as a concentrated single-part, ready-to-use aqueous color developing composition that can be diluted appropriately during or prior to use. In addition, it can be used as a processing tank or replenisher solution, or both.

In one embodiment of this invention, the color developing composition is one chemical formulation (dry or liquid) in a photographic processing chemical kit that can include one or more other photographic processing compositions (dry or liquid) including, but not limited to, a photographic bleaching composition, a photographic bleach/fixing composition, a photographic fixing composition, and a photographic stabilizing or a photographic final rinse composition. In addition, the color developing composition can be one part of a kit of two or more parts designed for preparing color developing solutions. Such additional compositions can be formulated in concentrated or working strength solutions, or provided in dry form (for example, powder, granules or tablet). Other processing compositions that can be included in such kits for color reversal processing are black-and-white development compositions, reversal compositions, conditioning compositions, prebleach compositions, acidic stop compositions, and others readily apparent to one skilled in the photographic art. The processing kits can also include various processing equipment, metering devices, processing instructions, silver recovery devices and other articles that would be readily apparent to one skilled in the art.

The following examples are provided to illustrate the practice of this invention and not to limit it in any way. Unless otherwise indicated, percentages are by weight.

EXAMPLE 1

Tar Formation Evaluation of Anti-Tar Agents

Several aqueous color developing compositions were evaluated for tar formation during a standing test. These compositions were prepared as follows.

A Control A composition which contained no anti-tar agent and KODAK Color Developing Agent CD-2, was prepared to be very similar in formulation to the conventional KODAK Process ECP-2B Color Developer currently used in the industry for processing color motion picture print films.

A Control B composition was prepared by adding conventional VERSA TL-73 sulfonated polystyrene (0.83 g/l, 30% solution, National Starch) to a sample of the Control A composition.

Compositions A–D were representative of the present invention containing various anti-tar agents that were found to be effective in controlling the formation of tar. Composition A was prepared by adding ZONYL FSO nonionic surfactants (0.05 g/l, 50% solution) to a sample of the Control A composition. Composition B was prepared by adding KLEARFAC AA270 anionic surfactant (0.2 g/l) to a sample of the Control A composition. Composition C was prepared by adding CARBOWAX 350 polyethylene glycol (0.2 g/l) to a sample of the Control A composition. Composition D was prepared by adding TWEEN 80 nonionic surfactant (0.2 g/l) to a sample of the Control A composition.

The compositions were evaluated as follows: 80 ml of fresh color developing composition (Control A) was placed in a glass vessel. The anti-tar agent was then added, and the compositions were allowed to stand open to the air at room temperature for at least 11 days. The compositions were observed periodically as well as at the end of the incubation period.

After 11 days, the Controls A and B compositions exhibited a considerable amount of a discontinuous oily film on the surface of the composition and oily precipitate on the bottom of the glass vessel, indicative of tar formation by degradation of the KODAK Color Developing Agent CD-2. In contrast, Compositions A–D (Invention) containing the anti-tar agents exhibited little or no oily film on the surface. Compositions A and B were the best compositions with no oily film observable on the surface, while Composition C exhibited some discontinuous oily film on the surface. Composition D exhibited even less discontinuous oily film on the surface and a minimal amount of oily precipitate on the bottom. Thus, the anti-tar agents added to Compositions A–D reduced or eliminated tar formation during the test.

In addition, after the eleven days, the Control compositions were considerably darkened while the invention Compositions A–D were less darkened and less turbid.

EXAMPLE 2

Further Anti-Tar Evaluations in Color Developing Compositions

The five color developing compositions described in Example 1, as well as an additional Composition E (prepared by the addition of 0.2 g/l of polyvinyl alcohol to a sample Control A composition) were similar prepared and evaluated except that only 50 ml of each composition were incubated for 3 days. This represents a more severe test since the volume of composition was smaller and thus degradation of color developing agent is more likely. The polyvinyl alcohol had an average molecular weight of 93,400.

The Control A composition was similarly unacceptable, and Compositions A–D showed similar results as described in Example 1. Composition E exhibited no oily film on its surface but did exhibit some solution haziness. Thus, polyvinyl alcohol and the four added surfactants reduced or eliminated tar formation during the incubation period.

EXAMPLE 3

Standing Tests and Evaluations of Color Developing Compositions

The procedure of Example 1 was repeated for several color developing compositions. Compositions B, B' and B" all contained the additive KLEARFAC AA270 anionic surfactant. Compositions F, F' and F" all contained the additive RHODAFAC LO-529 anionic surfactant. After incubation for 3 days, the compositions exhibited the following tar contamination as shown in the following TABLE I.

| COMPOSITION | ADDITIVE CONCENTRATION (g/l) | OBSERVATIONS* |
|---|---|---|
| Control A | 0 | ++ surface, ++ solution |
| Composition A | 0.05 (50% solution) | + surface |
| Composition B' | 0.05 | + surface, ++ solution, ++ bottom (droplets) |
| Composition B" | 0.1 | + bottom (droplets) |
| Composition B | 0.2 | + bottom (droplets) |
| Composition F | 0.05 | no contamination seen |
| Composition F' | 0.1 | no contamination seen |
| Composition F" | 0.2 | no contamination seen |

*+ designates the extent of tar contamination

All of the compositions of the present invention exhibited reduced tar contamination, especially at the higher anti-tar agent concentrations. One additive. RHODAFAC LO-529 exhibited no contamination at all tested concentrations.

EXAMPLE 4

Photographic Processing Using Improved Color Developing Composition

A conventional cine-type, sprocket-driven, high speed photographic processor using a color developing composition like Composition A described above was used to process samples of conventional EASTMAN EXR Color Print Film, 2386. It was observed that tar formation was effectively controlled by the addition of the anti-tar agent to the color developing solution used in the processing method.

The invention has been described in detail with particular reference to preferred embodiments thereof, but it will be understood that variations and modifications can be effected within the spirit and scope of the invention.

We claim:

1. A photographic color developing composition comprising:

a) at least 0.005 mol/l of a color developing agent, and b) at least 0.005 g/l of an anti-tar agent that is a fluoroalkylpolyethyleneoxy alcohol.

2. The composition of claim 1 wherein said anti-tar agent is present at a concentration of from about 0.01 to about 5 g/l.

3. The composition of claim 1 wherein said color developing agent is present at a concentration of from about 0.01 to about 1 mol/l, and said composition further comprises sulfite or an organic antioxidant in a concentration of from about 0.005 to about 1 mol/l.

4. The composition of claim 3 wherein said organic antioxidant is a mono- or dialkylhydroxylamine that has at least one sulfo, carboxy, hydroxy, amino, sulfonamido, carbonamido or phosphono substituent group.

5. The composition of claim 3 further comprising a sulfite.

6. The composition of claim 4 wherein said organic antioxidant is represented by Structure II:

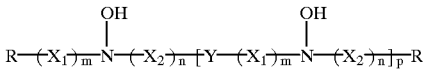

wherein R is hydrogen, an alkyl group, a haloalkyl group, a hydroxyalkyl group, a cycloalkyl group, or an aryl group, $X_1$ is —C(OH)$R_2$C$HR_1$—, $X_2$ is —C$HR_1$C(OH)$R_2$—, $R_1$ and $R_2$ are independently hydrogen, an alkyl group, hydroxy, or a hydroxyalkyl group, or $R_1$ and $R_2$ together represent the carbon atoms necessary to complete a 5- to 8-membered carbocyclic ring structure, Y is an alkylene group having at least 4 carbon atoms and an even number of carbon atoms in the chain, or Y is a divalent aliphatic group having at least 4 carbon or oxygen atoms in the chain and an even number of total atoms in the chain, and m, n and p are independently 0 or 1.

7. The composition of claim 1 that is an aqueous composition having a pH of from about 9 to about 13.

8. A kit for photographic processing comprising:

a) the color developing composition of claim 1, and b) one or more additional photographic processing compositions.

9. The kit of claim 8 wherein component a) is a single part necessary for preparing a color developing solution, and said kit further comprising one or more additional parts necessary for preparing said color developing solution.

10. A method of providing a photographic image comprising:

A) contacting an imagewise exposed color photographic silver halide element with the color developing composition of claim 1, and B) desilvering said color developed color photographic silver halide element.

11. A method of providing a photographic image comprising:

A) contacting an imagewise exposed color motion picture film for at least 15 seconds with a color developing composition comprising:

a) at least 0.005 mol/l of a color developing agent, and b) at least 0.005 g/l of an anti-tar agent that is a fluoroalkylpolyethyleneoxy alcohol, and B) desilvering said color developed color motion picture film.

* * * * *